US007882958B2

(12) United States Patent
Doppstadt et al.

(10) Patent No.: US 7,882,958 B2
(45) Date of Patent: Feb. 8, 2011

(54) DRUM SIEVE MACHINE

(76) Inventors: Johann L. Doppstadt, Voβnackerstrasse 67, Velbert (DE) 42555; Horst L. Berger, Bahnofstrasse 19, Calbe (DE) 39240

( * ) Notice: Subject to any disclaimer, the term of this patent is extended or adjusted under 35 U.S.C. 154(b) by 149 days.

(21) Appl. No.: 10/562,155

(22) PCT Filed: Jun. 24, 2004

(86) PCT No.: PCT/EP2004/006840

§ 371 (c)(1),
(2), (4) Date: Dec. 23, 2005

(87) PCT Pub. No.: WO2004/112973

PCT Pub. Date: Dec. 29, 2004

(65) Prior Publication Data

US 2006/0163120 A1 Jul. 27, 2006

(30) Foreign Application Priority Data

Jun. 25, 2003 (DE) ..... 203 09 857

(51) Int. Cl.
*B07B 1/00* (2006.01)

(52) U.S. Cl. ..... 209/245; 209/234; 209/244; 209/284; 209/667; 209/668

(58) Field of Classification Search ..... 209/234, 209/244, 245, 284, 288, 667, 668, 672, 673, 209/910
See application file for complete search history.

(56) References Cited

U.S. PATENT DOCUMENTS

| | | | | |
|---|---|---|---|---|
| 2,055,630 | A * | 9/1936 | McLean | 19/65 R |
| 5,248,042 | A * | 9/1993 | Kuhmonen | 209/234 |
| 6,149,018 | A * | 11/2000 | Austin et al. | 209/672 |
| 6,318,560 | B2 * | 11/2001 | Davis | 209/672 |
| 6,360,894 | B1 | 3/2002 | Devlin et al. | 209/291 |
| 6,843,376 | B2 * | 1/2005 | Dube et al. | 209/421 |
| 6,986,425 | B2 * | 1/2006 | Paladin | 209/671 |
| 2002/0056668 | A1 | 5/2002 | Dube et al. | 209/421 |

FOREIGN PATENT DOCUMENTS

| | | | |
|---|---|---|---|
| AU | 259866 | A | 9/1968 |
| DE | 3720490 | A1 | 12/1988 |
| DE | 4309671 | C1 | 5/1994 |
| DE | 9415108.3 | | 12/1994 |

(Continued)

OTHER PUBLICATIONS

Patent Abstracts of Japan, Bd. 0185, Nr. 08, Sep. 26, 1994, & JP6173294A (Nitto Seiko Co. Ltd.).

(Continued)

*Primary Examiner*—Stefanos Karmis
*Assistant Examiner*—Kalyanavenkateshware Kumar
(74) *Attorney, Agent, or Firm*—Jacobson Holman PLLC

(57) ABSTRACT

A trommel screen machine including at least one revolving screening drum, at least one drive for the screening drum, a feeding hopper as well as at least one collecting device, such as a transport device, for collecting and transporting the screened good. In front of and/or on the trommel screen machine at least one disc screen is arranged which screens a defined grain, in particular oversized particles.

23 Claims, 4 Drawing Sheets

FOREIGN PATENT DOCUMENTS

| | | | |
|---|---|---|---|
| DE | 3510597 | C2 | 11/1995 |
| DE | 4430682 | A1 | 3/1996 |
| DE | 20021216 | | 4/2001 |
| DE | 10100473 | A1 | 7/2002 |
| DE | 69603061 | T3 | 1/2003 |
| EP | 1304169 | | 4/2003 |

OTHER PUBLICATIONS

Patent Abstracts of Japan, Bd. 2000, Nr. 19, Jun. 5, 2001, & JP2001038292A (Sumikin Kogyo KK).

* cited by examiner

DRUM SIEVE MACHINE

This is a nationalization of PCT/EP04/006840 filed Jun. 24, 2004 and published in German.

FIELD OF THE INVENTION

The invention refers to a trommel screen machine with at least one revolving screening drum, one feeding hopper, one drive, and at least one collecting device, respectively transport device, for transporting the screened good.

BACKGROUND OF THE INVENTION

Trommel screen machines are known. They are used, for example, in recycling and sorting plants for separating material of different size, respectively graining. They offer altogether a wide range of application, for example for screening and classification of compost, in the recycling of tailings, for waste dump regeneration, screening of bark cuttings, shredded material, matured timber cuttings, tree cuttings, mixed construction waste, rumble, cinder, gravel, soils or the like.

With the trommel screen machines known so far it has to be seen as a disadvantage that as screened good only the good which is determined by the size of the openings in the screening drum has a defined particle size. The screened good which is conveyed out of the screening drum at its end in the direction of transport of the screening good, contains, as a rule, large amounts of oversized particles, so that this good has to be screened one more time, or has to be put altogether again in a comminution machine in order to get it in a certain, determined graining.

Thus the material finally leaving the screening drum has a particle size which can be assigned to a certain, determined size at about 90 percent. However, about 10 percent are obtained as oversized particles so that it is necessary to screen again or to put the complete good of this fraction to a comminution machine. This problem also occurs if a stone grit at the feeding hopper prevents certain oversized particles from entering. Here higher amounts of working time and energy occur which can also lead to the fact that the known trommel screen machines are only applied for pre-sorting, or are only used for screening good where the percentage of deviations from the graining described above can be neglected because they are too small.

This problem occurs in particular, for example, with trees from clearings, matured timber, cross-sills or the like comminuted, for example, by means of drum disintegrators or shredders. But also in the processing of tailings this problem is relevant.

SUMMARY OF THE INVENTION

Coming from the state of the art known as above it is an object of the invention to provide a trommel screen machine which does no more have the disadvantages described above.

The problem of the invention is solved by a trommel screen machine, comprising at least one revolving screening drum, at least one drive for the screening drum, a feeding hopper as well as at least one collecting device, respectively transport device, for collecting, respectively transport, of the screened good, which is characterised by the fact that in front of and/or on the trommel screen machine at least one disc screen is arranged which screens defined grain, in particular oversized particles. By means of the arrangement of a disc screen in front of, respectively on, the trommel screen machine the good leaving the screen drum at its end is determined as screened good of a defined graining. The width of the passage of the disc screen now defines sufficiently accurately the maximum graining of the mixing good.

In a trommel screen machine automatically another screened fraction is obtained which can be seen as defined, which leaves the drum screen at its end. The passage of the oversized particles through the disc screen is not possible anymore as it is the case, for example, with known stone grits. Therefore the invention provides a trommel screen machine which makes an additional defined fractioning of mixed goods possible. It is not relevant here whether so far one, two or three defined fractions have been provided by the respective trommel screen machine. In each case one defined fraction in addition to the fractions provided so far is obtained. The technical expenses concerning the plants, but also the process is reduced, energy is saved. This advantage occurs in particular by means of the arrangement of the disc screen directly before or on the trommel screen machine.

A development of the trommel screen machine according to the invention is therefore characterised by the fact that the disc screen is arranged on the feeding hopper of the trommel screen machine. Here the advantage of the invention as described before becomes particularly clear. By means of a simple, however effective, technical measurement a trommel screen machine with considerably improved features of use is obtained.

Another aspect of the invention concerns a trommel screen machine as described above which is characterised by the fact that the disc screen is designed in such a way that it can be folded, respectively turned, away. By means of this maintenance and cleaning are made considerably easier. For example, obstructions during the recycling of tailings can be removed very easily after turning away the disc screen.

According to the invention it has also been found to be an advantage if the trommel screen machine is characterised by a common drive for the screening drum and the disc screen. The technical expenses for machines, respectively plants, are thus reduced further. The drive for a screening drum is mostly dimensioned in such a way that a disc screen can actually also be driven by means of the drive of the screening drum. In the case that the drive is, for once, not dimensioned sufficiently so that it can drive both components the use of a larger dimensioned drive is mostly more convenient than the use of two separate drives.

Furthermore it is an advantage if at least the drive for the screening drum of the trommel screen machine is designed as direct drive, preferably as direct drive by means of a pinion. Thus the expenses for a gear are saved. The speed control in modern drives can be easily controlled by this drive.

A development of the trommel screen machine according to the invention is characterised by the fact that the dimensions of the disc screen are adapted to the size of the feeding hopper. Thus partial adaptations, respectively covers, in the feeding region are not necessary anymore.

According to another embodiment of the invention it is provided that the disc screen is arranged on the feeding hopper at an angle (alpha) inclined seen in the direction of transport of the screening drum. This makes screening, respectively sieving, of the oversized particles and, in particular, its transport easier. In the same it is achieved by that that all grainings of the screening good defined by the screen reach then the screening drum through the disc screen.

It has been found, according to a development of the trommel screen machine of the invention, to be an advantage if at least one adjusting device is provided by means of which the angle (alpha) of the disc screen can be adjusted with regard to the feeding hopper. Thus the angle can be varied easily according to the screening good so that the trommel screen machine can be used even more universally.

The trommel screen machine according to the invention is also characterised by the fact that a conveying device, for example a conveyor belt or a chute is provided for transporting the defined oversized particles. Thus the transport is made considerably more easier. For example, the oversized particles can be conveyed by the conveyor belt or chute, if necessary, via another conveyor belt one more time in a comminution machine, before it is then again, but once more comminuted, conveyed in the trommel screen machine.

Furthermore it is an advantage here if the conveying device is designed multipart, in particular in such a way that it can be angled, respectively turned away. In particular with mobile installations this is a measurement which makes transporting the machine easier.

Another advantage of the trommel screen machine according to the invention is given, according to a development, by the fact that the conveying direction of the conveying device for the oversized particles which have to be transported away is opposed to conveying direction of the screened good. Fractioning of the mixed good is thus influenced in a positive way.

According to the invention it has also been found to be an advantage if the conveying device is arranged before the feeding hopper with regard to the conveying direction of the screening good. The advantages referring the transport of a machine of this kind occur in the same way as described above.

According to a development of the trommel screen machine, as described before, it is provided that the disc screen is designed in such a way that it can be changed, respectively removed, in such a way that at least one stone grit, vibrating screen or the like can be arranged instead of the disc screen. This has the advantage that the machine ban be used in the known way, if, according to the nature of the screening good the use of a disc screen is not necessary.

Here it is provided, according to another aspect of the solution, that the stone grit, respectively the vibrating screen, is also designed that it can be folded, respectively turned away. This also results in an easier maintenance, respectively removal of troubles.

The problem of the invention is also solved by a disc screen, in particular for a trommel screen machine as described above, comprising at least two driven shafts provided with discs, the discs being arranged on the different shafts staggered, respectively engaging comb-like, to each other which is characterised by the fact that the shafts are designed in such a way that they can be exchanged. The possibility of exchanging the shafts makes the use of different shafts on, respectively in, a disc screen possible. Thus it is also a fact that different diameters of shafts, different diameters of discs, different distances on the shaft are possible on a single basic body of a disc screen. Worn shafts can be exchanged easily. Also resetting for different objections is now possible easily. By supplying differently equipped shafts a universal use is possible.

A convenient development of the disc screen described before therefore provide that the number, size and the distance of the discs to one another on the shafts can be varied.

Another aspect of the invention refers to a disc screen which is characterised by the fact that at least one of the discs is a polygon differing from the circle-shape.

It is furthermore provided that the discs are designed, according to a development of the disc screen described before, in such a way that they can be exchanged, in particular be pinned up, respectively inserted. Thus worn discs can be exchanged very conveniently. Also discs of different shapes and sizes may be positioned on one shaft.

Another modification of the disc screen according to the invention as described above, is characterised by the fact that spacers are provided which can be pinned, respectively inserted, on the shaft between the discs, and which are held by means of a clamping device on the shaft. Thus an exchange is even more efficient.

It is furthermore an advantage to provide at least one of the discs with at least one nap. The arrangement of naps leads to a further improvement of the screening result. In particular long pieces are prevented from passing through the screen, the dimensions of which are for example such that they might pass the screen on edge. Thus observing of the once predetermined particle size is even more secured altogether.

Conveniently the nap is here attached to the perimeter of the discs.

It has been found here to be an advantage, if the discs have, arranged at the perimeter, several borings in each of which a nap can be fixed, respectively attached to, in a releasable, fixed way.

According to the concept of the invention to guarantee a high number of different applications of the trommel screen machine, it is provided furthermore that the number, size and shape of the naps is designed such that it can be varied, in particular be changed, respectively be exchanged.

The naps have, for example, a rectangular, square, circular, respectively oval, cross section. The shape of the naps, as mentioned before, must not be understood here as restricting in any way. That depends on the respective screening application.

The invention also refers to a trommel screen machine with a disc screen as described before.

The invention also provides a recycling plant, respectively a sorting plant, with at least one trommel screen machine as described above, and/or at least one disc screen, as described above.

In the following the invention is described further by means of embodiments and drawings.

DETAILED DESCRIPTION OF THE PREFERRED EMBODIMENTS

Figure 1:
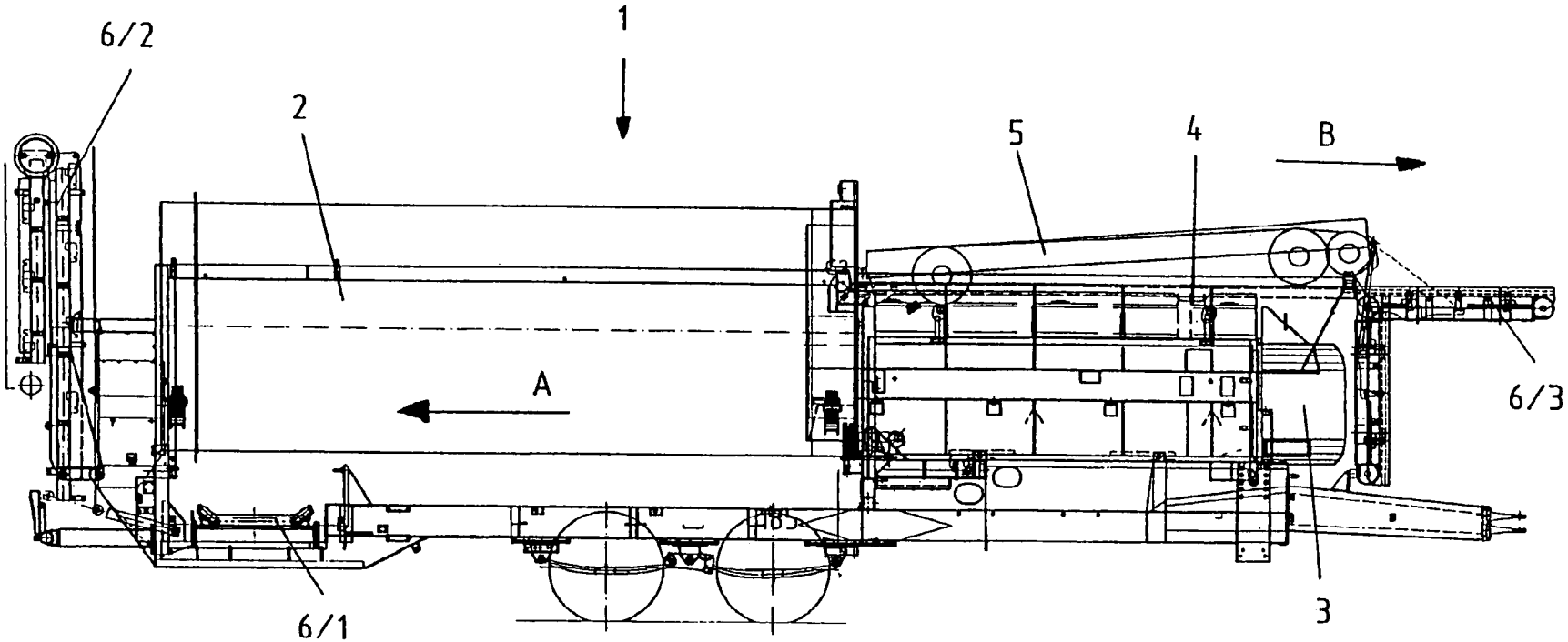
FIG. 1 section through a trommel screen machine according to the invention

FIG. 1 is a section through an embodiment of a trommel screen machine according to the invention. Reference number 1 here indicates the trommel screen machine altogether. On the left hand side of the drawing the screening drum 2 is arranged. The arrow with reference number A within the screening drum 2 refers to the conveying direction of the screening good within the screening drum. At the end of the screening drum 2 there is a first collecting and transport device 6/1 underneath for the screened, respectively sieved, good which gets through the openings of the screening drum 2 in a collecting room not shown in detail. Via a conveyor belt as part of the collecting and transporting device 6/1 the screened good is conveyed away from the trommel screen machine.

At the end of the screening drum 2 another collecting and transport device 6/2 is arranged. During screening it is lowered, respectively folded down, so that the good moved back within the screening drum 2 can leave there, and can be also transported away by means of the device, for example a conveyor belt. The screened good which is conveyed out of the screening drum in the transport direction A of the screening good at the end of the screening drum 2, still has, according to the state of the art, in the average large amounts of oversized particles, so that this good has to be screened once more or it has to be put again in a comminution machine altogether in order to get a determined particle size.

This problem is removed according to the invention by the arrangement of an additional disc screen 5 on, respectively in front of, the trommel screen machine 1. In the shown embodiment the disc screen 5 is arranged on the feeding hopper 4. The disc screen 5 is here arranged on the feeding hopper 4 at an inclined angle alpha with regard to the transport direction. Angle alpha can be designed, respectively adjusted, here according to the respective screening task.

The screening good is, according to the invention, passed at first over the disc screen 5, from which the graining defined by the adjustment of the disc screen 5 gets in the feeding hopper 4 and then in the screening drum 2. The screening drum 2 has openings which may be defined, for example, according to the undersized particles for the screening good. These undersized particles then are collected by the collecting and transport device 6/1 and transported away. The good now determined by the adjustment of the disc screen 5 and the size of the openings of the screening drum 2 now reaches the end of the screening drum 2 and then leaves it to the collecting and transport device 6/2.

The oversized particles which do not get through the screening drum are conveyed by the disc screen 5 to a conveying device 6/3 which conveys in a conveying direction B opposed to the conveying direction A of the screening good in the screening drum 2. The conveying device 6/3 is shown in the drawing according to FIG. 1 in a folded position for the transport of the trommel screen machine 1.

Thus the result of a trommel screen machine 1 according to the embodiment described before are two defined fractions of the mixed good for immediate use, respectively processing, and the oversized particles which have to be transported again, if necessary, to a comminution machine. Reference number 3 indicates the drive which is used for driving screening drum 2 as well as disc screen 5.

Figure 2B:
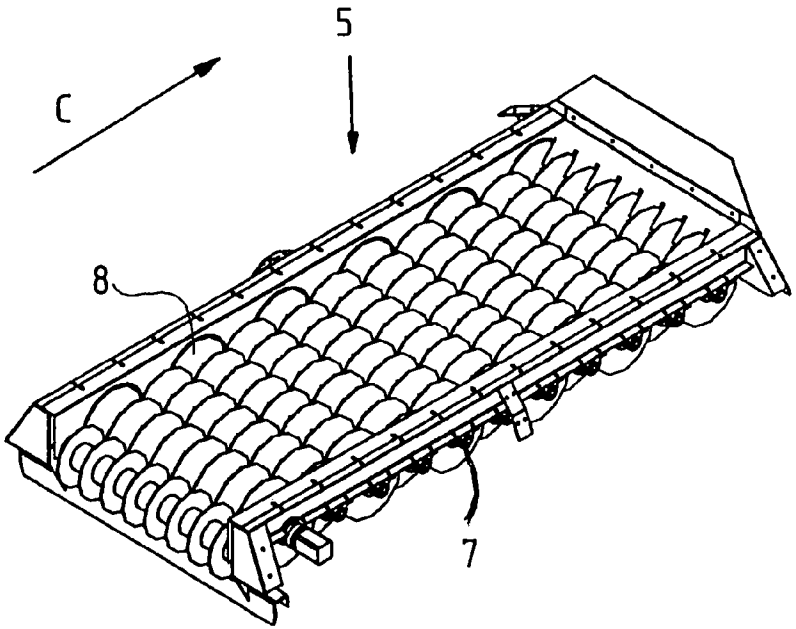
FIGS. 2*a* and 2*b* embodiment of a disc screen according to the invention FIGS. 3*a* and 3*b* side and front view of an embodiment of a shaft FIGS. 4*a* and 4*b* embodiment of a nap
Figure 2A:
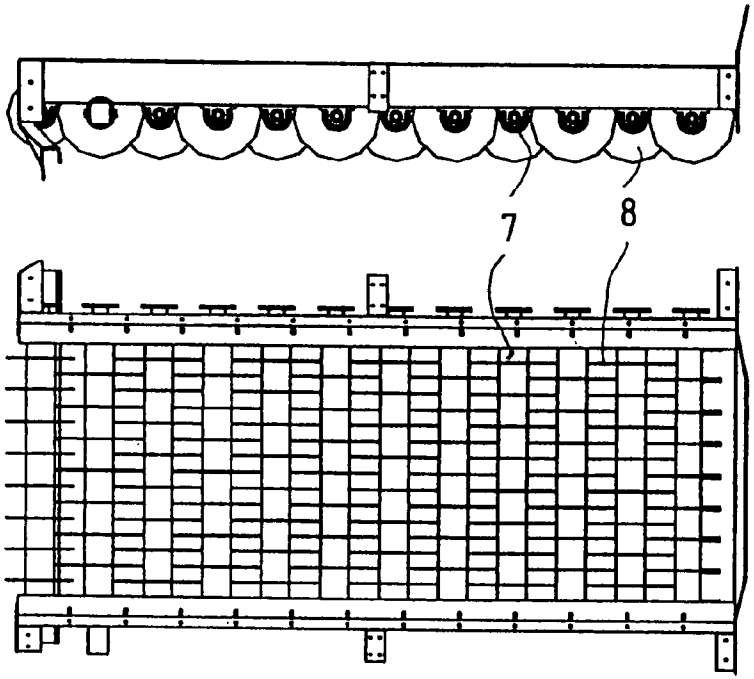

FIGS. 2*a* and 2*b* show an embodiment of a disc screen 5 according to the invention. Here several shafts 7 are arranged one behind the other in the conveying direction C. The second shaft 7 located in the conveying direction C is squared the square being connected with the drive, for example, via a gear. The single shafts 7 are coupled to one another so that the drive can be carried out via a single shaft 7. On the shafts 7 the discs 8 are arranged. These may be arranged fixedly, for example welded, as well as releasably fixedly on the shaft 7, for example by means of a clamping device. The size of the discs 8, their number and the distance between them can be varied according to the respective screening task. For that reason it is also an advantage if the shafts 7 are designed in such a way that they can be changed, respectively exchanged. The discs 8 are here attached to the different shafts 7 in such away that the discs 8 are arranged staggered, respectively engaging comb-like to one another. The distance of the discs 8 to one another, respectively the occurring spaces between the discs, define the size of the particles, respectively the largest dimension of the screening material.

Figure 3B:
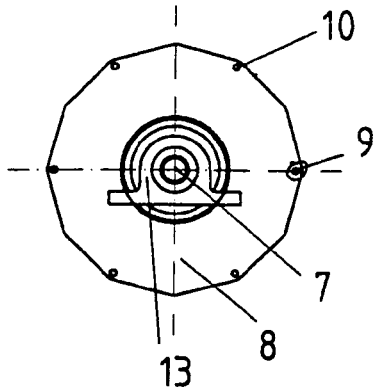
Figure 3A:
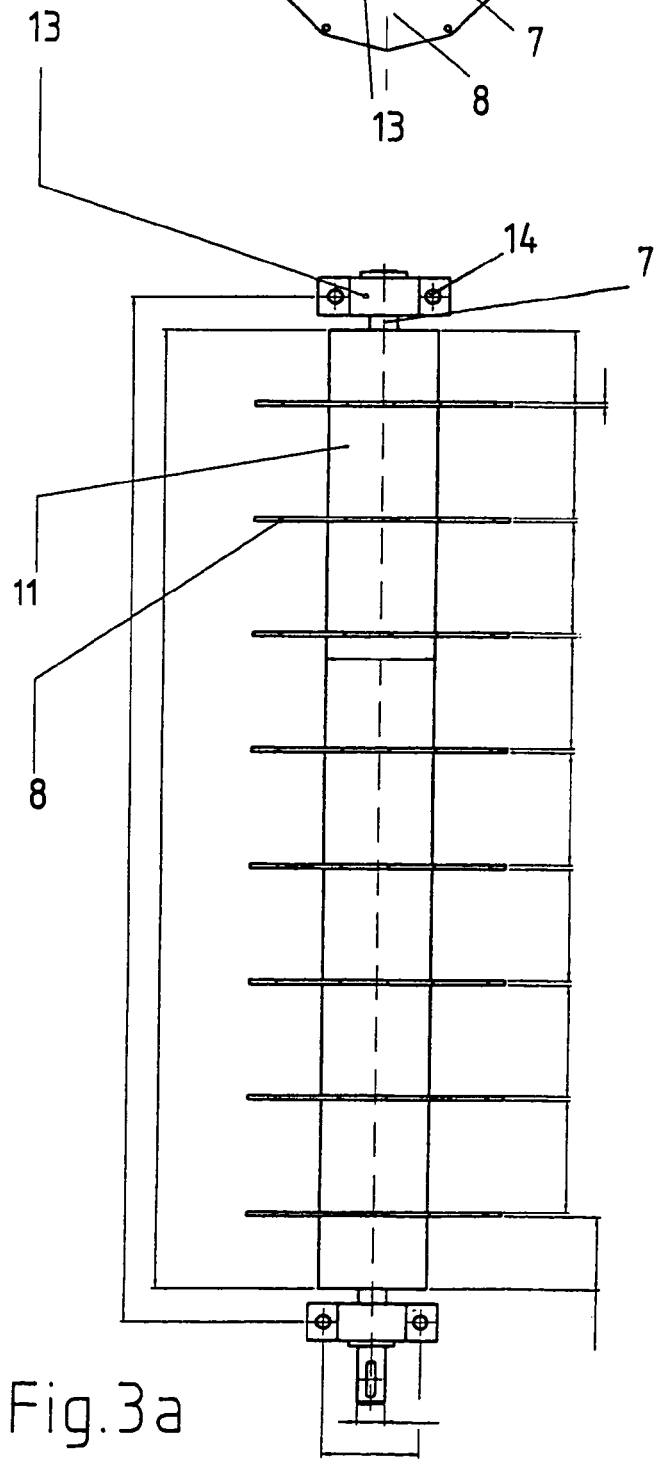

FIG. 3*a* shows a side view through an embodiment of a shaft 7 for a disc screen 5. Reference number 7 indicates the shaft. On the shaft 7 spacers 11 and discs 8 are arranged alternating. The shaft 7 is attached to, respectively on, the basic frame, respectively basic body (not shown in the figure) of the disc screen 5 by means of a bearing box 13. The bearing box has openings which are provided for attaching the shaft, for example, by means of screws to the basic frame, respectively basic body. A clamping device, which is not shown in detail, keeps the discs 8 and the spacers 11 on the shaft 7.

In FIG. 3*b* the front view of the view according to FIG. 3*a* is shown. Here borings are indicated which serve for holding, respectively fixing, naps 9. The borings 10 are arranged here on the perimeter of the disc 8.

Figure 4A:
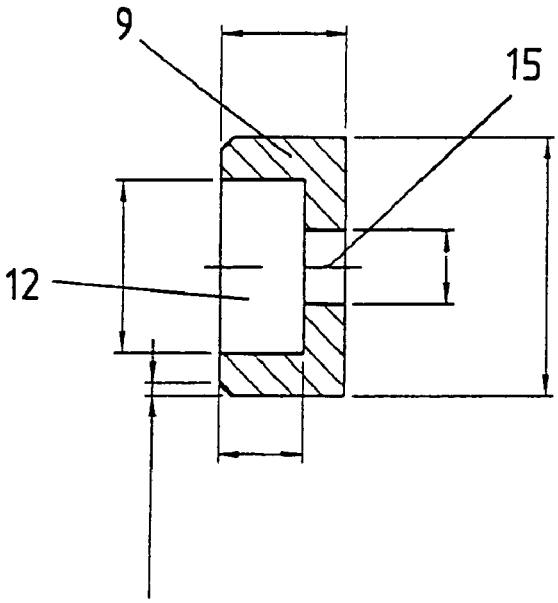
Figure 4B:
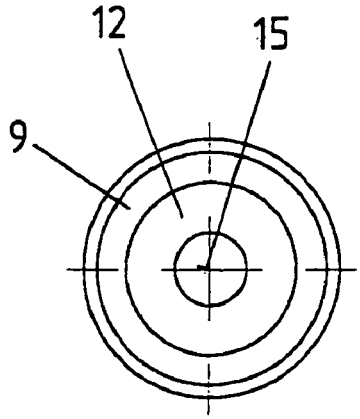

In FIGS. 4*a* and 4*b* an embodiment of a nap 9 is presented. In the nap 9 here a recess 12, respectively an impression, is provided in which a not-shown fastening means may be located. Reference number 15 indicates the boring through which the not-shown fastening means is guided if the nap 9 is connected through the boring 10 with the disc 8.

Before the invention has been described by way of examples. The claims filed now and to be filed later on together with the application are attempted formulations without prejudice for obtaining a broader protection.

References in the sub-claims relate to the further design of the matter of the main claim through the characteristics of the respective sub-claim. These are, however, not to be understood as a waiver of independent protection of the matter for the characteristics of the referred sub-claims.

Characteristics only disclosed in the description so far may, in the course of proceedings, be claimed as being of inventive relevance, for example to distinguish from the state of the art.

The invention claimed is:

1. Trommel screen machine, comprising at least one revolving screening drum, at least one drive for the screening drum, a feeding hopper located on a side of the screening drum, at least one disc screen located upstream from the feeding hopper, directly vertically above the feeding hopper and completely covering the feeding hopper for dropping already screened product into the feeding hopper, said at least one disc screen being at a height vertically above the screening drum, and the at least one disc screen being at an angle with respect to a transport direction of goods through the screening drum and through the feeding hopper, said at least one disc screen having a first end and a second end, said first end being located adjacent to the screening drum, said second end being spaced from said screening drum and being at a higher elevation than said first end, said feeding hopper feeding goods screened by the at least one disc screen to the at least one screening drum, a first collecting and transport device for collecting and transporting screened undersized goods from the screening drum, a second collecting and transport device for collecting and transporting predetermined sized goods from the at least one screening drum, a third collecting and transport device for collecting and transporting screened oversize goods from the at least one disc screen.

2. The trommel screen machine according to claim 1, wherein the disc screen is foldable.

3. The trommel screen machine according to claim 1, wherein the at least one drive for the screening drum also drives the disc screen.

4. The trommel screen machine according to claim 1, wherein at least the drive for the screening drum is a direct drive.

5. The trommel screen machine according to claim 1, wherein dimensions of the disc screen correspond to a size of the feeding hopper.

6. The trommel screen machine according to claim 1, wherein at least one adjusting device is provided by which the angle of the disc screen is adjusted with respect to the feeding hopper.

7. The trommel screen machine according to claim 1, wherein a conveying direction of the third conveying device for the defined oversized particles is opposed to a transport direction of the screened good.

8. The trommel screen machine according to claim 7, wherein the conveying device is arranged before the feeding hopper with regard to the transport direction of the screened good.

9. The trommel screen machine according to claim 1, wherein the disc screen is removable so that at least one vibrating screen is arranged instead of the disc screen.

10. The trommel screen machine according to claim 1, wherein the disc screen is removable so that at least one vibrating screen is arranged instead of the disc screen and the vibrating screen is foldable.

11. The trommel screen machine according to claim 1, wherein the at least one disc screen includes at least two driven shafts provided with discs, the discs are arranged on the at least two driven shafts staggered with respect to each other and the shafts are exchangeable.

12. The trommel screen machine according to claim 1, wherein the at least one disc screen includes at least two driven shafts provided with discs, the discs are arranged on the at least two driven shafts staggered with respect to each other and the shafts are exchangeable and a number, size and distance of between the discs with respect to one another is varied on the shafts.

13. The trommel screen machine according claim 1, wherein the at least one disc screen includes at least two driven shafts provided with discs, the discs are arranged on the at least two driven shafts staggered with respect to each other and at least one of the discs differs from a circular shape and is a polygon.

14. The trommel screen machine according to claim 1, wherein the at least one disc screen includes at least two driven shafts provided with discs, the discs are arranged on the at least two driven shafts staggered with respect to each other and the discs are exchangeable on the shaft.

15. The trommel screen machine according to claim 1, wherein the at least one disc screen includes at least two driven shafts provided with discs, the discs are arranged on the at least two driven shafts staggered with respect to each other and spacers are provided between the discs on the shaft, and are held on the shaft.

16. The trommel screen machine according to claim 1, wherein the at least one disc screen includes at least two driven shafts provided with discs, the discs are arranged on the at least two driven shafts staggered with respect to each other and at least one of the discs has at least one nap.

17. The trommel screen machine according to claim 1, wherein the at least one disc screen includes at least two driven shafts provided with discs, the discs are arranged on the at least two driven shafts staggered with respect to each other and at least one of the discs has at least one nap and the nap is attached to a perimeter of the discs.

18. The trommel screen machine according to claim 1, wherein the at least one disc screen includes at least two driven shafts provided with discs, the discs are arranged on the at least two driven shafts staggered with respect to each other and at least one of the discs has at least one nap and the discs have, arranged on a perimeter, several borings in each of which at least one nap is fixed in a releasable way.

19. The trommel screen machine according to claim 1, wherein the at least one disc screen includes at least two driven shafts provided with discs, the discs are arranged on the at least two driven shafts staggered with respect to each other and at least one of the discs has at least one nap and a number, size and shape of the naps varies so that the naps are exchangeable.

20. The trommel screen machine according to claim 1, wherein the at least one disc screen includes at least two driven shafts provided with discs, the discs are arranged on the at least two driven shafts staggered with respect to each other and at least one of the discs has at least one nap and the at least one nap has one of a rectangular, square, circular, and oval cross section.

21. A recycling plant including at least one trommel screen machine according to claim 1.

22. The recycling plant according to claim 21, further comprising a disc screen including at least two driven shafts provided with discs, the discs are arranged on the at least two driven shafts staggered with respect to each other and the shafts are exchangeable.

23. A trommel screen machine comprising a disc screen for receipt of screening goods, a feeding hopper, said disc screen being mounted on the feeding hopper directly above the feeding hopper and completely covering the feeding hopper for passage of screening goods from the disc screen to the feeding hopper, a screening drum connected to the feeding hopper for conveying screening goods in a first direction through the screening drum and for receipt of screening goods from the feeding hopper, the feeding hopper being located on a side of the screening drum, said at least one disc screen having a first end and a second end, said first end being located adjacent to the screening drum, said second end being spaced from said screening drum and being at a higher elevation than said first end, a first collecting and transport device located below the screening drum for receipt of screening goods from the screening drum, a second collecting and transport device connected to the screening drum for receipt of screened goods based on a size of openings of the disc screen, and a conveying device for receipt of oversized particles moving in a second direction from the disc screen, said second direction being opposite to said first direction.

* * * * *